US008413743B2

(12) United States Patent
Nagasaka et al.

(10) Patent No.: US 8,413,743 B2
(45) Date of Patent: Apr. 9, 2013

(54) POWER TOOLS

(75) Inventors: Hidenori Nagasaka, Anjo (JP); Xiang Ren, Anjo (JP); Akira Tomonaga, Anjo (JP); Tatsuya Yoshizaki, Anjo (JP)

(73) Assignee: Makita Corporation, Anjo (JP)

( * ) Notice: Subject to any disclaimer, the term of this patent is extended or adjusted under 35 U.S.C. 154(b) by 279 days.

(21) Appl. No.: 12/850,154

(22) Filed: Aug. 4, 2010

(65) Prior Publication Data

US 2011/0030986 A1 Feb. 10, 2011

(30) Foreign Application Priority Data

Aug. 6, 2009 (JP) ..... 2009-183425

(51) Int. Cl.
*B25F 5/02* (2006.01)
*B25F 5/00* (2006.01)

(52) U.S. Cl. ..... 173/216; 173/217; 173/170; 173/171; 173/162.1; 173/162.2; 403/119; 403/120; 403/161; 403/154; 310/50; 310/51

(58) Field of Classification Search ..... 173/216–217, 173/170–171, 162.1, 162.2; 403/119, 120, 403/161, 154; 310/50–51
See application file for complete search history.

(56) References Cited

U.S. PATENT DOCUMENTS

| | | | | |
|---|---|---|---|---|
| 6,286,610 | B1 | 9/2001 | Berger et al. | |
| 6,364,033 | B1 * | 4/2002 | Hung et al. | 173/217 |
| 7,557,534 | B2 * | 7/2009 | Uehlein-Proctor et al. | 320/112 |
| 2001/0000882 | A1 | 5/2001 | Giardino et al. | |
| 2006/0086515 | A1 * | 4/2006 | Engelfried | 173/162.2 |
| 2006/0267556 | A1 | 11/2006 | Uehlein-Proctor et al. | |
| 2009/0194306 | A1 | 8/2009 | Johnson et al. | |
| 2009/0266571 | A1 | 10/2009 | Baumann et al. | |

FOREIGN PATENT DOCUMENTS

| | | | |
|---|---|---|---|
| DE | 40 00 861 | A1 | 7/1991 |
| DE | 197 30 356 | A1 | 1/1999 |
| DE | 10 2005 059 180 | A1 | 6/2007 |
| EP | 1 550 532 | A1 | 7/2005 |
| EP | 1 674 212 | A1 | 6/2006 |
| JP | A-2007-283471 | | 11/2007 |
| WO | WO 2004/016399 | A1 | 2/2004 |

OTHER PUBLICATIONS

European Search Report issued in European Patent Application No. 10008181.9 dated Jun. 14, 2011.

* cited by examiner

*Primary Examiner* — Brian D Nash
*Assistant Examiner* — Michelle Lopez
(74) *Attorney, Agent, or Firm* — Oliff & Berridge, PLC

(57) ABSTRACT

A plurality of components of a power tool are coupled to each other to form a component assembly. Positioning members are disposed within a housing body and resiliently support the component assembly from opposite sides in an axial direction.

23 Claims, 4 Drawing Sheets

POWER TOOLS

This application claims priority to Japanese patent application serial number 2009-183425, the contents of which are incorporated herein by reference.

BACKGROUND OF THE INVENTION

1. Field of the Invention

The present invention relates to power tools having a housing for receiving components therein.

2. Description of the Related Art

Japanese Laid-Open Patent Publication No. 2007-283471 discloses a known power screwdriver having a housing that includes a tubular housing body and a grip portion. Within the housing body, a gear section, a motor as a drive source, and a switch for operating the motor are coaxially arranged in series in this order from the front side. A tool bit is rotatably driven by the motor via the gear section. Opposite ends with respect to the axial direction of these components (i.e., the gear section, the motor and the switch) are respectively supported by projection's formed on the inner wall of the housing body, so that the components are fixed in position relative to the housing body in the axial direction and can be prevented from being displaced in the axial direction.

However, because the axially opposite ends of the components are respectively supported by the projections, some of the projections are positioned between two adjacent components. Therefore, the length of an assembly of the components from the front end to the rear end may increase by the thickness of the projections each positioned between two adjacent components. As a result, the length of the entire housing body and eventually the length of the entire screwdriver increases.

Further, because two projections are needed for supporting each of the components, a large number of projections are necessary and the configuration of the inner wall of the housing body is complicated.

Therefore, there is a need in the art for a power tool having a minimum length and a simply configured housing body.

SUMMARY OF THE INVENTION

A plurality of components of a power tool are coupled to each other to form a component assembly. Positioning members are disposed within a housing body and resiliently support the component assembly from opposite sides in an axial direction.

DETAILED DESCRIPTION OF THE INVENTION

Figure 1:
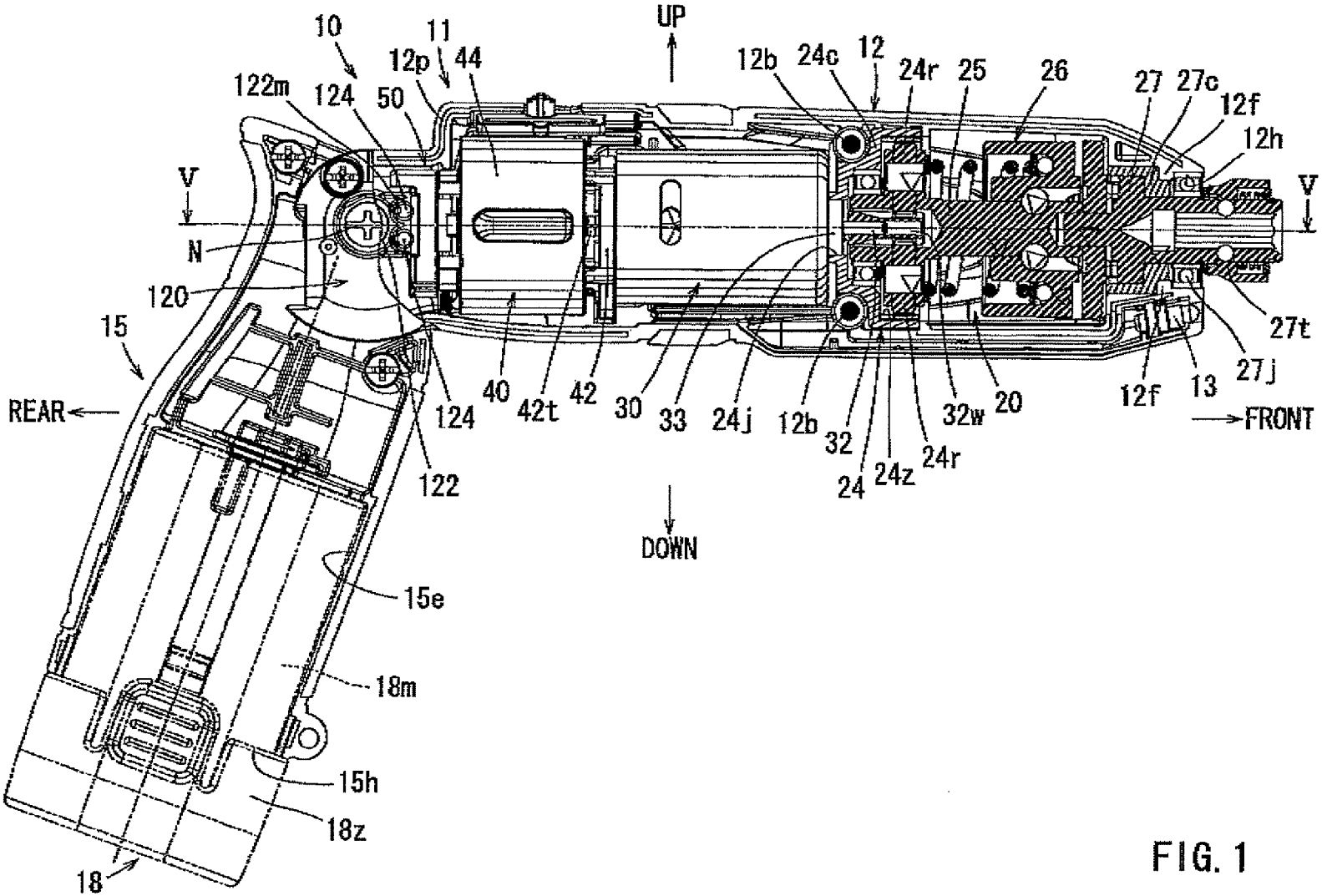
FIG. 1 is a side view, with some portions shown in vertical cross section, of a power tool according to an example.

Each of the additional features and teachings disclosed above and below may be utilized separately or in conjunction with other features and teachings to provide improved power tools. Representative examples of the present invention, which examples utilize many of these additional features and teachings both separately and in conjunction with one another, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful examples of the present teachings.

In one example, a power tool has a housing including a tubular housing body. A component assembly includes a plurality of components coupled in series with each other in an axial direction and is received within the housing body. A first positioning member and a second positioning member are disposed at an inner wall of the housing body and support the component assembly from opposite sides in the axial direction, so that the component assembly can be held in position in the axial direction relative to the housing body. A resilient member is disposed between the component assembly and at least one of the first and second positioning members.

Therefore, it is not necessary to provide an additional positioning member, such as a projection, between two adjacent components. Hence, the length of the entire component assembly, and eventually, the length of the power tool as well as the length of the housing body can be reduced or minimized. Further, because the number of positioning members can be reduced, the construction of the housing body, in particular the configuration of the inner wall of the housing body, can be simplified.

In the case of a component assembly having a plurality of components coupled in series with each other, an accumulative error in length of the component assembly due to the potential manufacturing errors of the components may be increased. However, because the resilient member is provided between the component assembly and the first positioning member, it is possible to absorb the accumulative error in length by the resilient deformation of the resilient member.

The housing body may have a base end portion having a flat box-shaped configuration. The housing may further include a grip portion having a recess formed therein for receiving the base end portion of the housing body. The first positioning member and the resilient member may be positioned within the base end portion of the housing body.

With this arrangement, the positioning member and the resilient member can be received within the base end portion, and therefore, these members may not narrow the space of the housing body provided for receiving the components. Therefore, the space of the housing body can be effectively used.

The base end portion may have a cylindrical tubular portion extending therein. The grip portion may have a joint shaft portion disposed at a position of the recess and inserted into the cylindrical tubular portion, so that the housing body can pivot relative to the grip portion about an axis of the joint shaft portion. A groove having an arc-shaped cross section and defining the first positioning member may be formed in an outer circumferential surface of the cylindrical tubular portion of the housing body and may extend in an axial direction of the cylindrical tubular portion. The resilient member may have a rod-like shape and may be fitted into the groove.

Therefore, the resilient member can be held in stable between the first positioning member and the component assembly. In addition, the resilient member having a rod-like shape can provide a large deformation tolerance in comparison with the construction in which the resilient member has a flat plate-like shape.

The component assembly may include a gear section for rotating a tool bit, a motor as a drive source, a switch for operating the motor, and an element case for receiving electronic elements that can control the rotation of the motor based on signals outputted from the switch. The element case may be disposed within the base end portion of the housing body. With this arrangement, it is not necessary to provide an additional space within the housing body for positioning the electronic elements. Therefore, the length of the entire power tool can be reduced also in this respect.

A power tool according to a representative example will now be described with reference to FIGS. 1 to 5. In this example, the power tool is configured as a pencil impact screwdriver having a rechargeable battery.

As shown in FIG. 1, a power tool 10 has a housing 11 including a tubular housing body 12 and a grip portion 15 that is vertically pivotally joined to the base end portion of the housing body 12. A user can grasp the grip portion 15 during the use of the power tool 10. The grip portion 15 has left and right semi-tubular grip members 150*a* and 150*b* (see FIG. 5) that are joined to each other to form the grip portion 15. The grip portion 15 defines therein a battery storage space 15*e* (see FIG. 1) for receiving a case body 18*m* of a battery pack 18. To this end, the grip portion 15 has an access opening 15*h* formed in its leading end portion (lower end portion as viewed in FIG. 1). The battery pack 18 is a battery unit including a battery and a case for receiving the battery therein and has the case body 18*m* and a grip forming portion 18*z*. The case body 18*m* is inserted entirely into the battery storage space 15*e* of the grip portion 15, so that the battery pack 18 is mechanically connected to the grip portion 15, and at the same time, the battery of the battery pack 18 is electrically connected to an electric circuit of the power tool 10. In this connected state, the grip forming portion 18*z* of the battery pack 18 constitutes a leading end portion extending outwardly from the grip portion 15.

Figure 3:
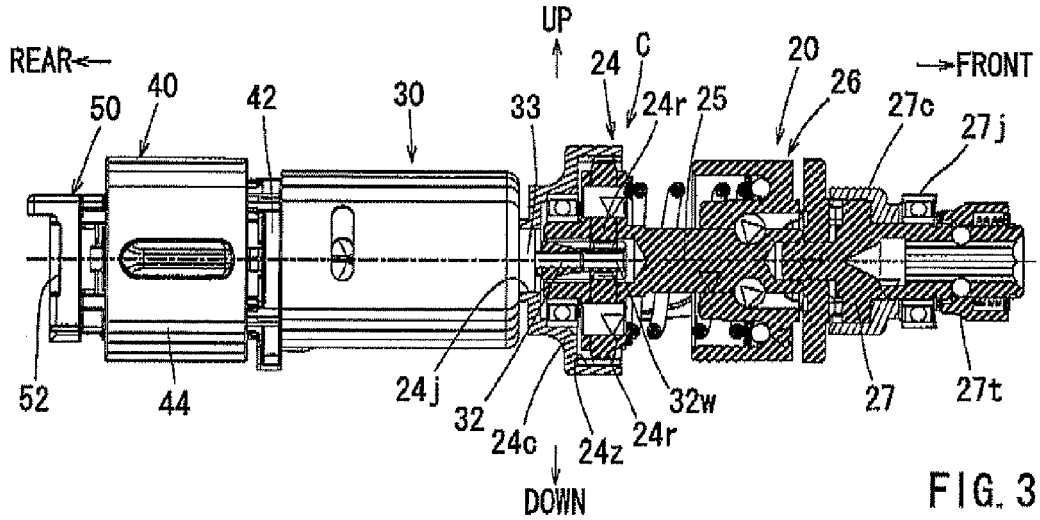
FIG. 3 is a side view, with some portions shown in vertical cross section, of a component assembly of the power tool.

The housing body 12 is configured as a split-type housing and includes a left housing member 120*a* and a right housing member 120*b* each having a semi-tabular configuration. The left and right housing members 120*a* and 120*b* are joined to each other to form the housing body 12 that has a tubular configuration. Within the housing body 12, a gear section 20, a motor 30, a switch 40 and an element case 50 are coaxially disposed in series with each other in this order from the front side. As shown in FIGS. 1 and 3, the gear section 20 includes a planetary gear mechanism 24 for reducing the rotational speed of the motor 30, a spindle 25 rotatably driven by the motor 30 via the planetary gear mechanism 24, an impact force generating device 26 capable of converting the rotational force of the spindle 25 into a rotary impact force, and an anvil 27 capable of receiving the rotary impact force from the impact force generating device 26. The anvil 27 is supported by a bearing 27*j* and can rotate about its axis. A chuck 27*t* is mounted to the front end portion of the anvil 27, so that a tool bit, such as a driver bit or a socket bit (not shown) can be held by the chuck 27*t*.

As shown in FIGS. 1 to 4, the motor 30 has a substantially cylindrical motor housing. A front bearing 33 and a rear bearing 34 (see FIG. 4) are mounted to the central portion of the front end surface and the central portion of the rear end surface of the motor housing, respectively, for rotatably supporting a rotary shaft 32 of the motor 30. As shown in FIGS. 1 and 3, the rotary shaft 32 protrudes forwardly beyond the front bearing 33. A motor-side gear 32*w* is mounted to the protruded end of the rotary shaft 32 and engages a pair of planetary gears 24*r* of the planetary gear mechanism 24. The front bearing 33 of the motor 30 is fitted into a bearing support 24*j* of a case portion 24*c* having an outer ring gear 24*z* formed thereon, so that the motor 30 is coupled to the planetary gear mechanism 24 of the gear section 20 coaxially therewith.

Figure 4:
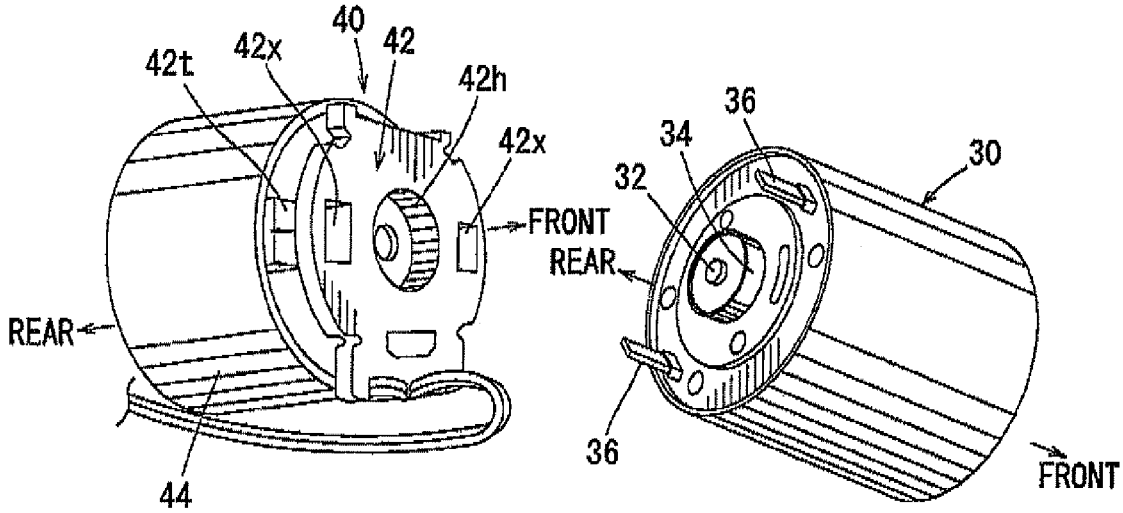
FIG. 4 is an explanatory perspective view showing a connecting structure between a motor and a switch of the power tool.

As shown in FIG. 4, a pair of terminals 36 are mounted to the peripheral portion of the rear end surface of the motor housing of the motor 30 so as to extend in the axial direction at positions opposed to each other with the rear bearing 34 positioned therebetween.

The switch 40 can be operated for changing the rotational direction of the motor 30 between the normal direction and the reverse direction, adjusting the rotational speed of the motor 30, and turning on and off an LED 13 used for illumination. The switch 40 includes a tubular switch body 42 and a cylindrical tubular trigger 44. The tubular switch body 42 receives a switch circuit therein. The cylindrical tubular trigger 44 covers the switch body 42 and is rotatable relative to the switch body 42 about the same axis as the switch body 42. Rotating the trigger 44 rightward from a reference position causes the LED 13 to be turned on and causes the motor 30 to rotate in the normal direction. In addition, as the rotational angle of the trigger 44 increases, the rotational speed of the motor 30 increases. On the other hand, rotating the trigger leftward from the reference position causes the LED 13 to be turned on but causes the motor 30 to rotate in the reverse direction. Also in this case, the rotational speed of the motor 30 increases as the rotational angle of the trigger 44 increases.

As shown in FIG. 4, in the front end surface of the switch body 42 of the switch 40, openings 42 are formed at positions corresponding to the terminals 36 of the motor 30. At positions on the inner side of the openings 42, switch-side terminals 42*t* are positioned for connection with the respective terminals 36, ha the central portion of the front end surface of the switch body 42, a cylindrical recess 42*h*, into which the rear bearing 34 of the motor 30 is fitted, is formed.

The terminals 36 of the motor 30 are inserted into the openings 42*x* of the switch body 42 so as to be electrically connected to the switch-side terminals 42*t*, and thereafter, the rear bearing 34 is fitted into the cylindrical recess 42*h* of the switch body 42, so that the motor 30 and the switch 40 are coaxially connected to each other.

As shown in FIG. 3, the element case 50 has a substantially inverted L-shape as viewed from a lateral side and is fixed to the rear end surface of the switch housing 42 with the element case 50 oriented vertically. Within the element case 50, electronic elements, such as a FET for rotational control of the motor 30, and diodes for protecting the FET are disposed. Power source terminals (not shown) for an electric circuit of the power tool 10 are disposed on the outer side surface of the element ease 50.

Therefore, as shown in FIG. 3, the gear section 20, the motor 30, the switch 40 and the element case 50 received within the housing body 12 are coupled in series with each other to form a coupled component assembly C.

Figure 5:
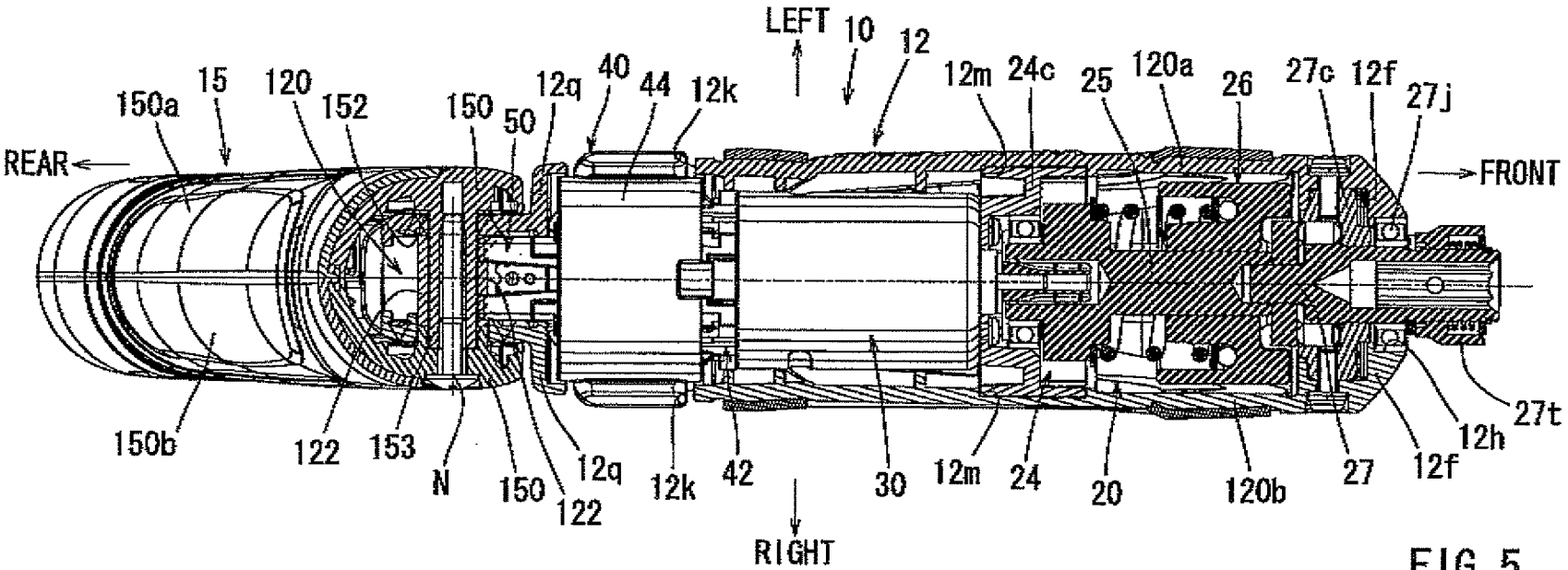
FIG. 5 is a horizontal sectional view of the power tool taken along line V-V in FIG. 1.

The construction of the housing body 12 will now be described. As shown in FIGS. 1 and 5, at the front end of the housing body 12, a bearing support portion 12*h* is formed for supporting the bearing 27*j* for the anvil 27 of the gear section 20. On the rear side of the bearing support portion 12*h*, a front support portion 12*f* is formed for supporting the case 27*c* of the anvil 27 from its radially outer side and the front side. Here, as shown in FIG. 4, the left housing member 120*a* and the right housing member 120*b* constituting the housing body 12 are secured to the case 27*c* of the anvil 27 by means of screws. As shown in FIG. 1, the LED 13 is mounted to the housing body 12 at a position on the lower side of the front support portion 12*f*.

As shown in FIG. 5, the outer peripheral portion of the case portion 24*c* of the planetary gear mechanism 24 constituting the gear section 20 is fitted into a shallow recess portion 12*m* formed in the central portion with respect to front and rear directions of the inner wall of the housing body 12 and extending in the circumferential direction. Further, upper and lower screw support portions 12*b* (see FIG. 1) are formed on the housing body 12 at positions on the rear side of the shallow recess portion 12*m* in order to allow insertion of screws that connect between the left housing member 120*a* and the right housing member 120*b*. The upper and lower screw support portions 12*b* also support the case portion 24*c* of the planetary gear mechanism 24 from the rear side.

In this way, the gear section 20 is supported by the bearing support portion 12*h* and the front support portion 12*f* of the housing body 12 from the front side, while the gear section 20 is supported by the shallow recess portion 12*m* and the screw support portions 12*b* from the rear side. Therefore, the gear section 20 is held in position in the axial direction.

Referring to FIG. 5, rectangular openings 12*k* are formed in the rear portion of the housing body 12 at positions on the left side and the right side thereof so as to be opposed to the trigger 44 of the switch 40. Therefore, portions of the outer surface of the trigger 44 are exposed to the outside at positions of the rectangular openings 12*k*, so that the user can operate to rotate the trigger 44 of the switch 40 from the outer side of the housing body 12.

A portion of the housing body 12 on the rear side of the switch 40 has a height and a width that are smaller than those of the remaining portion of the housing body 12, so that a vertically stepped portion 12*p* stepped along the vertical direction (see FIG. 1) and a pair of symmetrical right and left horizontally stepped portions 12*q* stepped along the horizontal direction (see FIG. 5). Further, as shown in FIGS. 1 and 5, on the rear side of the stepped portions 12*p* and 12*q*, a flat box-shaped base end portion (rear end portion) 120 is formed, and the element case 50 is received within the base end portion 120.

Figure 2:
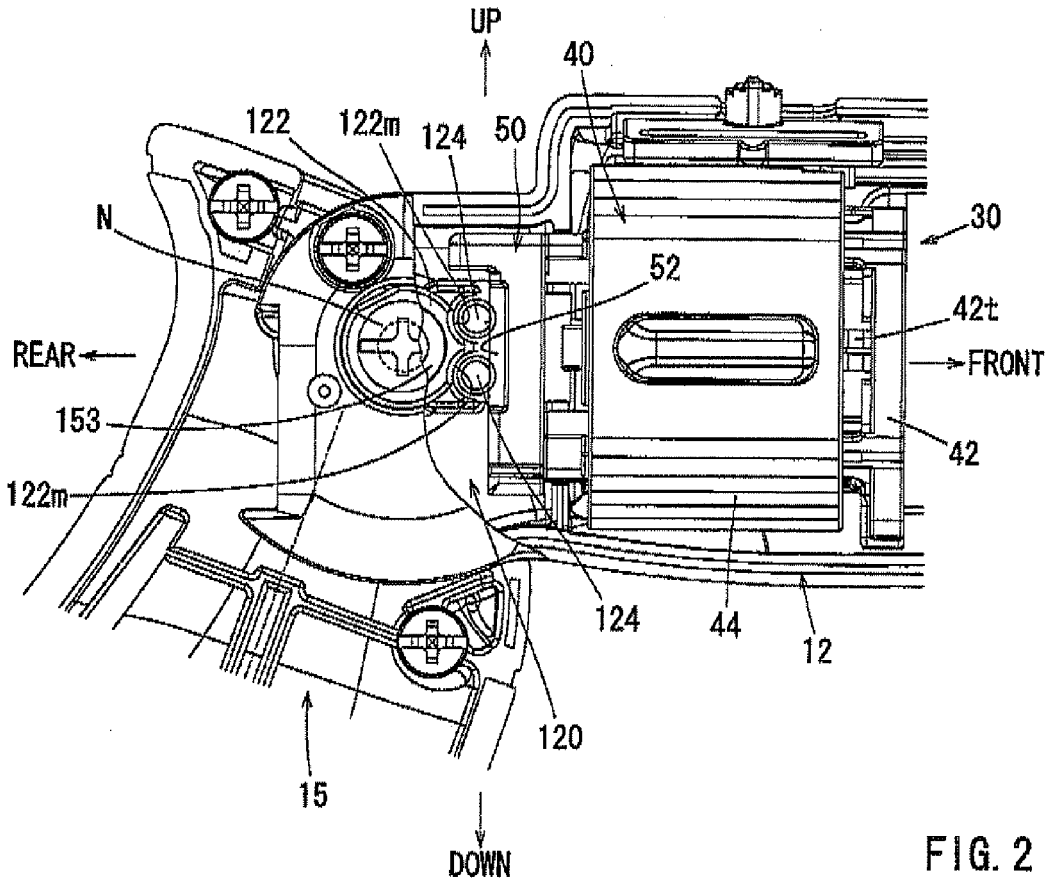
FIG. 2 is an enlarged view of a part of FIG. 1 and showing a positioning member and resilient members.

The base end portion 120 of the housing 12 is joined to the grip portion 15. To this end, a cylindrical tubular portion 122 is formed within the base end portion 120 and extends horizontally (in right and left direction) through the central portion of the base end portion 120. In addition, as shown in FIG. 2, upper and lower grooves 122*m* each having an arc-shaped cross section and extending in the axial direction (right and left direction) of the cylindrical tubular portion 122 are formed in the front portion of the outer circumferential surface of the cylindrical tubular portion 122 positioned within the base end portion 120. As will be explained later, the cylindrical tubular portion 122 serves to rotatably support a joint shaft portion 153 (see FIGS. 2 and 5) of the grip portion 153 and also serves to support the element case 50, which is fixed to the switch 40, from the rear side. A pair of rod-like resilient members 124 are held between a rear end surface 52 of the element case 50 and the cylindrical tubular portion 122 in such a state that the resilient members 124 are fitted into the upper and lower grooves 122*m*, respectively. In this way, the rear end of the component assembly C including the gear section 2, the motor 30, the switch 40 and the element case 50 is supported by the cylindrical tubular portion 122 and the rod-like resilient members 124 from the rear side. The resilient members 124 may be made of elastomer, such as rubber and synthetic resin elastomer.

Therefore, the cylindrical portion 122 of the housing body 12 serves as a positioning member that defines a projection for supporting the component assembly C from one side in the axial direction, while the bearing support portion 12*h*, the front support portion 12*f*, the shallow recess portion 12*m* and the screw support portions 12*b* serve as positioning members that define projections for supporting the component assembly C from the other side in the axial direction.

A joint structure for joining between the housing body 12 and the grip portion 15 will now be described. The base end portion (upper end portion as viewed in FIG. 1) of the grip portion 15 serves as a portion for joining to the base end portion 120 of the housing body 12 and has left and right support walls 150 formed on the left and right grip members 150*a* and 150*b*, respectively, as shown in FIG. 5. A recess 152 is defined by and between the support walls 150, so that the base end portion 120 of the housing body 12 can be fitted into the recess 152. The joint shaft portion 153 extends horizontally from the left support wall 150 to the right support wall 150 through substantially the central portion of the recess 152. The joint shaft portion 153 is inserted into the cylindrical tubular portion 122 of the housing body 12. In this way, the base end portion 120 of the housing body 12 and the base end portion of the grip portion 15 are joined to each other so as to be able to pivot vertically relative to each other about an axis of the joint shaft portion 153.

The joint shaft portion 153 of the grip portion 15 is configured to have a tubular shape and a screw N can be inserted into the joint shaft portion 153 for joining the left grip member 150*a* and the right grip member 150*b* together.

According to the power tool 10 of this example, a plurality of components (i.e., the gear section 20, the motor 30, the switch 40 and the element case 50) are coupled in series with each other to form the component assembly C. The component assembly C is supported by the cylindrical tubular portion 122, the bearing support portion 12*h* and the front support portion 12*f*, etc. (serving as positioning members that define projections) from opposite sides in the axial direction, so that the component assembly C is fixed in position with respect to the axial direction of the housing body 12. Therefore, it is not necessary to provide projections between two adjacent components of the component assembly C, and hence, it is possible to reduce the entire length of the component assembly C by the lengths of the unnecessary positioning members or projections. As a result, it is possible to reduce the entire length of the housing body 12 and eventually the entire length of the power tool 10. In addition, because it is possible to minimize the number of necessary positioning members, it is possible to simplify the configuration of the inner wall of the housing body 12.

In the case that a plurality of components are coupled in series with each other to form the component assembly C as described above, a potential dimensional error in the lengthwise direction of the component assembly C may be increased due to accumulation of potential manufacturing errors of the components. However, in the above embodiment, the resilient members 124 are positioned between the component assembly C and the cylindrical tubular portion 122 (i.e., the positioning member that defines a projection), and therefore, the accumulated dimensional error in the lengthwise direction of the component assembly C can be absorbed by the resilient deformation of the resilient members 124. Therefore, it is possible to improve the durability of the motor 30 and the switch 40.

Further, the base end portion 120 of the housing body 12 is formed to have a flat box-shaped configuration and is fitted into the recess 152 of the grip portion 15, and the cylindrical tubular portion 122 (i.e., the positioning member defining the projection) and the resilient members 124 are disposed within the base end portion 120 of the housing body 12. Thus, the positioning member (or the projection) and the resilient members 124 can be positioned within the base end portion 120. In some cases, the base end portion 120 is not so suitable for receiving the components due to its flat box-shaped configuration. Therefore, the positioning member and the resilient members 124 may not narrow the space within the housing body 12 available for receiving the components. As a result, it is possible to effectively use the space within the housing body 12.

Furthermore, the grooves 122*m* each having an arc-shaped cross section are formed in the outer circumferential surface of the cylindrical tubular portion 122 (i.e., the positioning member defining a projection) of the housing body 12 and extend in the axial direction of the cylindrical tubular portion 122. Because the rod-shaped resilient members 124 are fitted in the grooves 122*m* formed in this way, it is possible hold the resilient members 124 in stable between the cylindrical tubular portion 122 (i.e., the positioning member defining a projection) and the component assembly C (in particular, the rear end surface 52 of the element case 50). In addition, because each of the resilient members 124 has a rod-like shape, it is possible to ensure a large deformation tolerance in comparison with a resilient member having a flat plate-like shape.

The above example may be modified in various ways. For example, although in the above example, the grooves 122*m* each having an arc-shaped cross section are formed in the outer circumferential surface of the cylindrical tubular portion 122 and each of the resilient members 124 has a rod-like shape to be fitted into the corresponding groove 122*m*, each of the groves 122*m* may have a rectangular cross section and each of the resilient members 124 may have a rectangular column-like configuration. In addition, the resilient members 124 may be replaced with leaf springs. Further, the number of the resilient members 124 and the grooves 122*m* may be one or three or more.

Furthermore, although the above example has been described in connection with the power tool 10 configured as a pencil impact screwdriver, the present invention may be applied to any other type of power tools, such as a non-impact type screwdriver and a drill.

What is claimed is:

1. A power tool comprising:

a housing including a tubular housing body;

a component assembly including a plurality of components coupled in series with each other in an axial direction and received within the housing body, the component assembly having opposite sides in the axial direction;

a first positioning member and a second positioning member disposed at an inner wall of the housing body and supporting the component assembly from the opposite sides, so that the component assembly can be held in position in the axial direction relative to the housing body; and a resilient member disposed between the component assembly and at least one of the first and second positioning members, wherein:

the plurality of components includes a first component positioned at one end in the axial direction and a second component positioned at an other end in the axial direction, the first positioning member is configured to engage the first component, the second positioning member is configured to engage the second component, and the resilient member is disposed between the first positioning member and the first component.

2. The power tool as in claim 1, wherein:

the housing body has a base end portion having a flat box-shaped configuration;

the housing further includes a grip portion having a recess formed therein for receiving the base end portion of the housing body; and the first positioning member and the resilient member are positioned within the base end portion of the housing body.

3. The power tool as in claim 2, wherein:

the base end portion has a cylindrical tubular portion extending therein;

the grip portion has a joint shaft portion disposed at a position of the recess and inserted into the cylindrical tubular portion, so that the housing body can pivot relative to the grip portion about an axis of the joint shaft portion;

a groove having an arc-shaped cross section and defining the first positioning member is formed in an outer circumferential surface of the cylindrical tubular portion of the housing body and extends in an axial direction of the cylindrical tubular portion; and the resilient member has a rod-like shape and is fitted into the groove.

4. The power tool as in claim 1, wherein the components in the component assembly include a gear section for rotating a tool bit, a motor as a drive source, a switch for operating the motor, and an element case for receiving electronic elements that can control the rotation of the motor based on signals outputted from the switch.

5. The power tool as in claim 1, wherein the first and second positioning members are formed integrally with the inner wall of the housing body.

6. The power tool as in claim 1, wherein each of the first and second positioning members comprises a projection.

7. The power tool as in claim 1, wherein the resilient member is made of elastomer.

8. The power tool as in claim 7, wherein the resilient member comprises a plurality of resilient members.

9. The power tool as in claim 1, wherein the first positioning member and the second positioning member are disposed at positions proximal to opposite ends in the axial direction of the component assembly, and there is no positioning member between the first and second positioning members.

10. A power tool comprising:

a housing including a housing body;

a component assembly including a plurality of components and received within the tubular housing body, the component assembly having a first end and a second end opposite to the first end in an axial direction;

a first positioning member and a second positioning member disposed at the housing body and positioned to oppose to the first end and the second end of the component assembly in the axial direction, respectively, so that the component assembly can be held in position in the axial direction relative to the housing body; and a resilient member disposed between the component assembly and at least one of the first and second positioning members, wherein:

the plurality of components includes a first component positioned at one end in the axial direction and a second component positioned at an other end in the axial direction, the first positioning member is configured to engage the first component, the second positioning member is configured to engage the second component, and the resilient member is disposed between the first positioning member and the first component.

11. The power tool as in claim 10, wherein:

the housing body has a base end portion having a flat box-shaped configuration;

the housing further includes a grip portion having a recess formed therein for receiving the base end portion of the housing body; and the first positioning member and the resilient member are positioned within the base end portion of the housing body.

12. The power tool as in claim 11, wherein:

the base end portion has a cylindrical tubular portion extending therein;

the grip portion has a joint shaft portion disposed at a position of the recess and inserted into the cylindrical tubular portion, so that the housing body can pivot relative to the grip portion about an axis of the joint shaft portion;

a groove having an arc-shaped cross section and defining the first positioning member is formed in an outer circumferential surface of the cylindrical tubular portion of the housing body and extends in an axial direction of the cylindrical tubular portion; and the resilient member has a rod-like shape and is fitted into the groove.

13. The power tool as in claim 10, wherein the components in the component assembly include a gear section for rotating a tool bit, a motor as a drive source, a switch for operating the motor, and an element case for receiving electronic elements that can control the rotation of the motor based on signals outputted from the switch.

14. The power tool as in claim 10, wherein the first and second positioning members are formed integrally with an inner wall of the housing body.

15. The power tool as in claim 10, wherein each of the first and second positioning members comprises a projection.

16. The power tool as in claim 10, wherein the resilient member is made of elastomer.

17. The power tool as in claim 10, wherein the resilient member comprises a plurality of resilient members.

18. The power tool as in claim 10, wherein there is no additional positioning member between the first positioning member and the second positioning member along the length of the component assembly.

19. A power tool comprising:

a housing including a housing body;

a component assembly including a plurality of components and received within the tubular housing body, the component assembly having a first end and a second end opposite to the first end in an axial direction of the component assembly;

a first positioning member and a second positioning member disposed at the housing body and positioned to oppose to the first end and the second end of the component assembly in the axial direction, respectively, so that the component assembly can be held in position in the axial direction relative to the housing body; and a resilient member disposed between the component assembly and at least one of the first and second positioning members, wherein:

the housing body has a base end portion including a cylindrical tubular portion extending therein, the housing further includes a grip portion having a joint shaft portion pivotally connected to the cylindrical tubular portion, the first positioning member is the cylindrical tubular portion, and the resilient member is interposed between the cylindrical tubular portion and a rear surface of the component assembly in the axial direction of the component assembly.

20. The power tool as in claim 19, wherein:

the base end portion of the housing body has a flat box-shaped configuration, the grip portion has a recess formed therein for receiving the base end portion of the housing body, and the first positioning member and the resilient member are positioned within the base end portion of the housing body.

21. The power tool as in claim 20, wherein:

the joint shaft portion is disposed at a position of the recess and inserted into the cylindrical tubular portion, so that the housing body can pivot relative to the grip portion about an axis of the joint shaft portion;

a groove having an arc-shaped cross section and defining the first positioning member is formed in an outer circumferential surface of the cylindrical tubular portion of the housing body and extends in an axial direction of the cylindrical tubular portion; and the resilient member has a rod-like shape and is fitted into the groove.

22. A power tool comprising:

a housing including a tubular housing body;

a component assembly including a plurality of components coupled in series with each other in an axial direction and received within the housing body, the component assembly having opposite sides in the axial direction;

a first positioning member and a second positioning member disposed at an inner wall of the housing body and supporting the component assembly from the opposite sides, so that the component assembly can be held in position in the axial direction relative to the housing body; and a resilient member disposed between the component assembly and at least one of the first and second positioning members, wherein:

the housing body has a base end portion having a flat box-shaped configuration, the housing further includes a grip portion having a recess formed therein for receiving the base end portion of the housing body, the first positioning member and the resilient member are positioned within the base end portion of the housing body, the base end portion has a cylindrical tubular portion extending therein, the grip portion has a joint shaft portion disposed at a position of the recess and inserted into the cylindrical tubular portion, so that the housing body can pivot relative to the grip portion about an axis of the joint shaft portion;

a groove having an arc-shaped cross section and defining the first positioning member is formed in an outer circumferential surface of the cylindrical tubular portion of the housing body and extends in an axial direction of the cylindrical tubular portion; and the resilient member has a rod-like shape and is fitted into the groove.

23. A power tool comprising:

a housing including a housing body;

a component assembly including a plurality of components and received within the tubular housing body, the component assembly having a first end and a second end opposite to the first end in an axial direction;

a first positioning member and a second positioning member disposed at the housing body and positioned to oppose to the first end and the second end of the component assembly in the axial direction, respectively, so that the component assembly can be held in position in the axial direction relative to the housing body; and a resilient member disposed between the component assembly and at least one of the first and second positioning members, wherein:

the housing body has a base end portion having a flat box-shaped configuration, the housing further includes a grip portion having a recess formed therein for receiving the base end portion of the housing body, the first positioning member and the resilient member are positioned within the base end of the housing body, the base end portion has a cylindrical tubular portion extending therein, the grip portion has a joint shaft portion disposed at a position of the recess and inserted into the cylindrical tubular portion, so that the housing body can pivot relative to the grip portion about an axis of the joint shaft portion, a groove having an arc-shaped cross section and defining the first positioning member is formed in an outer circumferential surface of the cylindrical tubular portion of the housing body and extends in an axial direction of the cylindrical tubular portion; and the resilient member has a rod-like shape and is fitted into the groove.

* * * * *